United States Patent [19]

Piretti

[11] Patent Number: 4,978,168

[45] Date of Patent: Dec. 18, 1990

[54] CHAIR HAVING RETRACTABLE GANGING APPARATUS AND COOPERATING STACKING PAD

[76] Inventor: Giancarlo Piretti, Piazza Trento e Trieste, 2/2 Bologna, Italy

[21] Appl. No.: 506,170

[22] Filed: Apr. 9, 1990

[30] Foreign Application Priority Data

Sep. 25, 1989 [CA] Canada ..... 612998

[51] Int. Cl.[5] ..... A47C 15/00

[52] U.S. Cl. ..... 297/248; 297/239; 108/64; 108/91

[58] Field of Search ..... 297/248, 239; 108/64, 108/91; 248/293

[56] References Cited

U.S. PATENT DOCUMENTS 3,095,237 6/1963 Desnoyers et al. ..... 297/248

3,614,158 10/1971 Mohr ..... 297/248

*Primary Examiner*—Peter A. Aschenbrenner

*Assistant Examiner*—Joanne Bonifanti

*Attorney, Agent, or Firm*—Fuller, Ryan & Hohenfeldt

[57] ABSTRACT

A chair having ganging apparatus for interconnecting a number of such chairs together and a stacking pad is attached to the underside of the chair seat, the bottom surface of which conforms closely to the top surface of the seat. The ganging apparatus includes first and second ganging members, each connected to the seat underside, and swingable between a retracted position beneath the chair seat and an extended position extended out from under the chair seat. Both of the ganging members are wire-like members formed in a generally U-shape and are interlinked with corresponding members of an adjacent chair. The stacking pad accommodates the attachment of a frame, to which the legs and ganging members are attached. The pad includes recesses for accommodating the ganging members when in their retracted position. A spring is provided for biasing the ganging members toward the retracted position, and a catch is provided for locking the ganging members in the extended position. The leg portions of one ganging member are formed in an S-shape at the end of the leg portions nearest the cross portion. The S-shaped legs of the first ganging member thus interlink with the substantially straight cross portion of the second ganging member of the adjacent chair to secure the chairs in ganged relation. The S-shape thus permits the ganging of the chairs at a plurality of different ganging spacings.

13 Claims, 4 Drawing Sheets

CHAIR HAVING RETRACTABLE GANGING APPARATUS AND COOPERATING STACKING PAD

BACKGROUND OF THE INVENTION

This invention relates to the construction of chairs and seating furniture, and in particular to such chairs which may be stacked for storage and which may be interconnected or ganged for use in rows.

The most widely known type of structure for linking or ganging chairs together is structure that is fixed in place on the chairs, such as that shown in Ware, et al, U.S. Pat. No. 4,386,804. This patent shows each chair having applied to it a key on one side and an interlinking keyway on the other, so that ganged chairs can be separated merely by lifting a chair out of engagement with adjacent chairs.

There are instances, however, where it is desirable to remove the ganging structure from view when not in use. The Lieberman et al patent, U.S. Pat. No. 3,825,300, shows a ganging structure that is retractable, but that structure is still in view when retracted since it is attached to the legs, spaced down substantially from the seat. Mohr U.S. Pat. No. 3,614,158, on the other hand, shows a ganging device that is out of view when in its retracted position. The Mohr device, though, provides only a single member to connect the two chairs together, and the single member must be quite long to accommodate the distance between the chairs. Further, the Mohr chair is not shown to be a stackable chair, and stacking such a chair may cause special problems.

This invention relates to improvements to the apparatus described above and to solutions to the problems raised or not solved thereby.

SUMMARY OF THE INVENTION

The invention includes a chair comprising a seat, having an underside and legs for providing support to the seat. The invention provides ganging apparatus for interconnecting a number of such chairs together. This ganging apparatus includes first and second ganging members, each connected to the seat underside. The first ganging member is connected to the seat underside near one lateral side thereof, swingable between a retracted position beneath the chair seat and an extended position extended out from under the chair seat. The second ganging member is connected to the seat underside near the opposite lateral side thereof, and also swingable between a retracted position beneath the seat, and an extended position extended out from under the chair. Both of the ganging members are wire-like members formed in a generally U-shape, each with a pair of leg portions joined at one end by a cross portion. Each of the ganging members is provided with interlink means at the cross portion whereby each chair may be interlinked with an adjacent chair in ganged relation, with the legs of both of the U-shapes extending between the chairs. A stacking pad is attached to the seat underside, the bottom surface of which conforms closely to the top surface of the seat. The pad is shaped to spread the weight evenly from a stack of the chairs to minimize any stacking damage to the mating seat upholstery or polypropylene seats. The pad also covers and finishes the underside of the chair, eliminating pinch points and giving the chair a finished appearance. The pad includes means for accommodating the attachment of a frame, to which the legs and ganging members are attached. The pad includes recesses for accommodating the ganging members when in their retracted position. Distal portions of the leg portions opposite the cross portions are bent outward and rotatably affixed to the seat underside. Biasing means are provided for biasing the ganging members toward the retracted position, and catch means are provided for latching the ganging members in the extended position. The interlink means comprises the leg portions of the first ganging member each being formed in an S-shape at the end of the leg portions nearest the cross portion, the S-shape being formed in a plane transverse to the cross portion. The S-shaped legs of the first ganging member thus interlink with the cross portion of the second ganging member of the adjacent chair to secure the chairs in ganged relation. The legs of both of the U-shapes extend between the chairs, the S-shape thus permitting the ganging of the chairs at a plurality of different ganging densities.

DESCRIPTION OF THE PREFERRED EMBODIMENT

Figure 1:
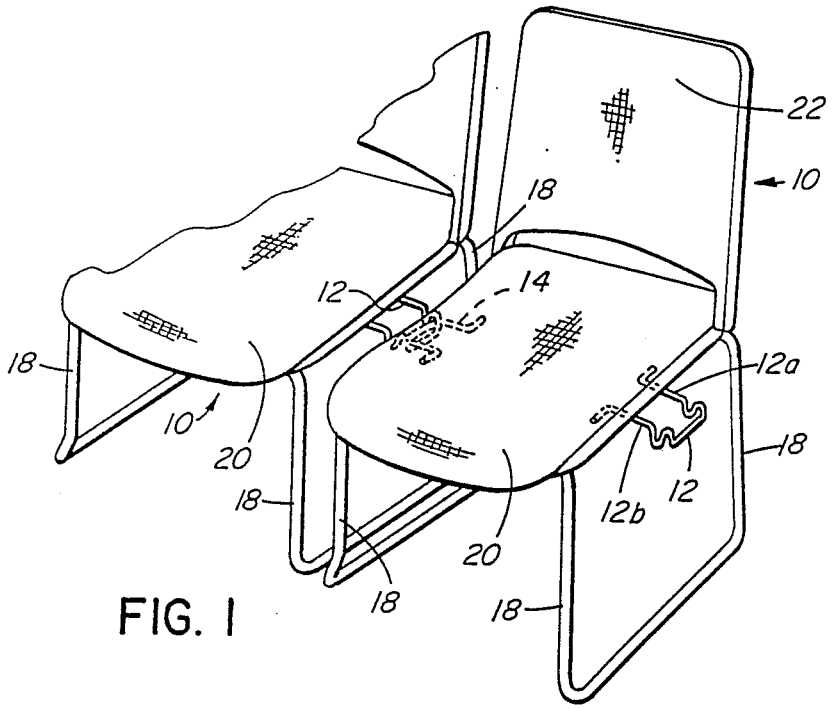
FIG. 1 is an isometric view of two chairs constructed according to a preferred embodiment of the invention, interconnected together.

Referring now to FIG. 1, there are shown two identical chairs 10 constructed according to a preferred embodiment of the invention. Each chair 10 is respectively provided with wire-like ganging members 12 and 14, by which the chairs are connected together. As shown best in FIG. 2, each of these ganging members 12 and 14 is wire-like and generally U-shaped, as seen there from the bottom. That is, ganging member 12 has two leg portions **12*a* and 12*b* joined together at one end by a cross portion 12*c*. Similarly, ganging member 14 has two leg portions 14*a* and 14*b* joined together at one end by a cross portion 14*c*. The opposite end of each of the legs 12*a*, 12*b*, 14*a* and 14*b* is bent outward away from the opposite leg of the same ganging member at about a right angle, to result in a foot 12*d* and 14*d*** respectively at the end of each leg.

Figure 2:
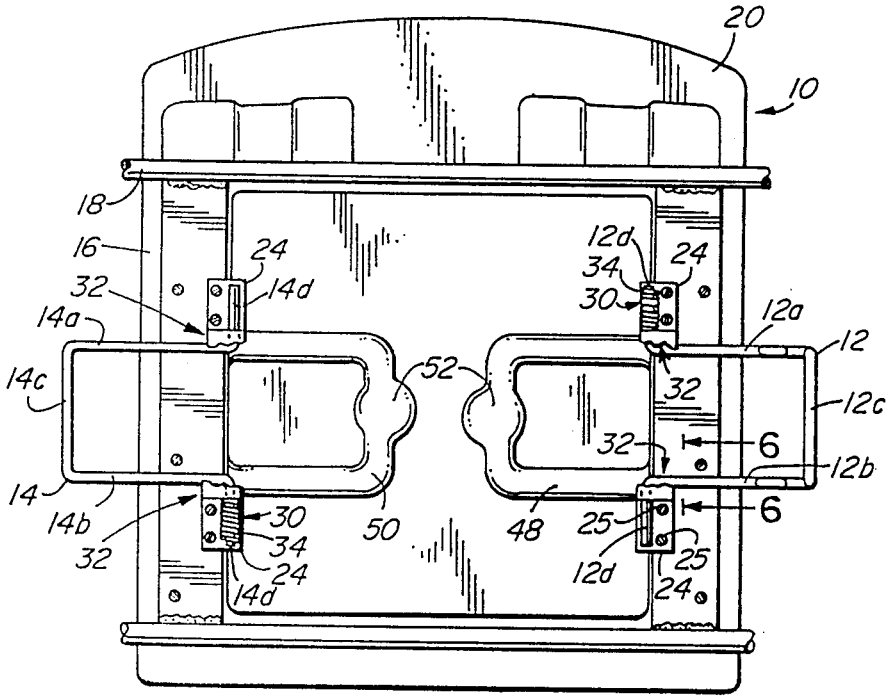
FIG. 2 is a bottom view of one of the chairs shown in FIG. 1, with the ganging members in their extended position.
Figure 3:
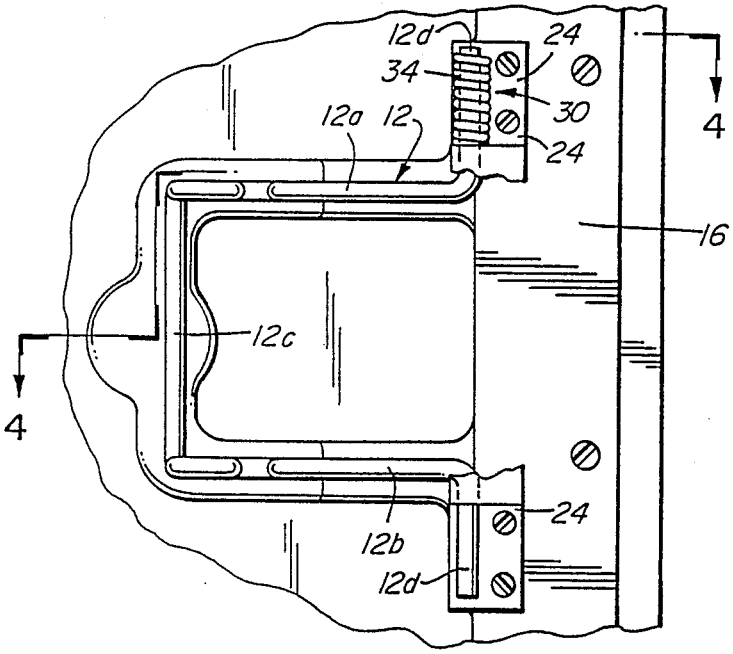
FIG. 3 is a bottom fragmentary view of the chair shown in FIG. 2, on an enlarged scale, with a ganging member shown in its retracted position.
Figure 4:
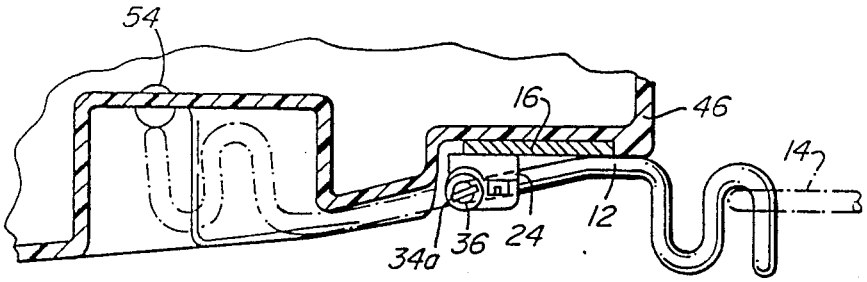
FIG. 4 a cross-sectional view of the chair portion shown in FIG. 3, taken generally along line 4—4, except showing the ganging member in phantom in its retracted position and in solid in its extended position.

In the preferred embodiment, the chair 10 is constructed of a frame 16, to which legs 18, a seat 20 and a back 22 (FIG. 1) are attached. Each ganging member 12 and 14 is pivotably attached to the frame 16 by means of a pair of hinge brackets 24 which are attached to the frame by any suitable means such as screws 25. The hinge brackets 24 each include an eye 26, which may be aligned with a channel 28 which may be formed in the bracket. The respective foot 12*d* or 14*d* of each ganging member 12 and 14 is inserted through the eye 26 and runs the majority of the length of the channel 28, if present, of the respective bracket. The two hinge brackets 24 for either ganging member 12 or 14 are spaced apart a sufficient distance to substantially match the distance between the two legs of the respective ganging member. The two hinge brackets 24 for each ganging member are attached to the frame 16 in such a way that the channels 28 of each face away from the opposing hinge bracket. With the hinge brackets 24, the respective ganging members are pivotable about the feet 12*d* and 14*d*, between a retracted position as shown in FIG. 3 and an extended position as shown in FIGS. 1, 2 and 4. The extended position is separated from the retracted position by about 180 degrees of rotation.

It is an object of the invention to provide ganging members which are maintained in a retracted position when not in use. The invention therefore provides for biasing means 30 for biasing the ganging members 12 and 14 toward the retracted position when not in use, and catch means 32 for latching the ganging members in the extended position when in use.

Figure 5:
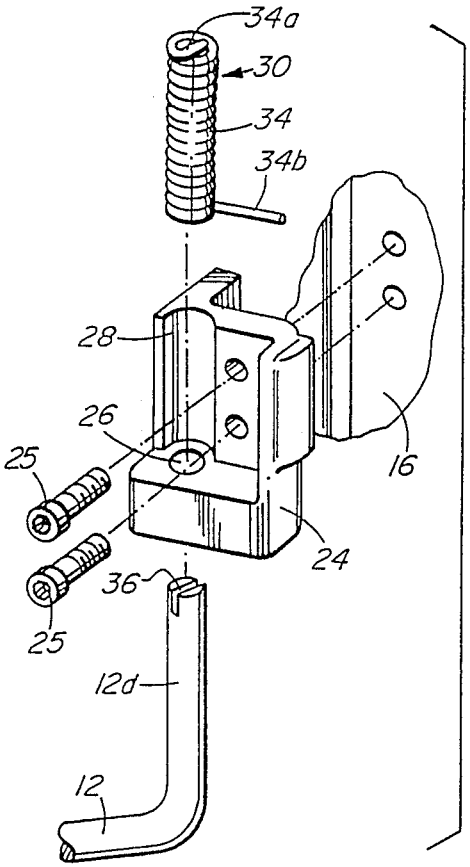
FIG. 5 is an exploded isometric view of a hinge bracket and related parts constructed according to a preferred embodiment of the invention.

In the particular preferred embodiment shown in the drawing figures, the biasing means 30 includes a coil spring 34 coiled about one of each of the feet 12*d* and 14*d*. Referring now to FIGS. 4 and 5, a slot 36 is formed in the end surface of the foot 12*d* and 14*d* about which the spring 34 is coiled. The end of the coil spring 34 nearest that end has a straight portion 34*a*, which is placed in that slot 36 to prevent rotation of that end of the spring with respect to the foot. That is, with the end of the coil spring 34 placed in the slot 36, that end of the spring will rotate with the foot as the ganging member is rotated between its extended and retracted position. The opposite end of the spring 34 includes a second straight portion 34*b*, which bears on the hinge bracket 24, so as to prevent rotation of that end of the spring with respect to the hinge bracket. Thus the foot 12*d* or 14*d*, and in turn the respective ganging member 12 or 14, is biased toward the retracted position by the spring 34.

Figure 6:
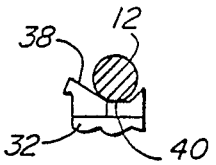
FIG. 6 is a cross-sectional view of a portion of the chair shown in FIG. 2, taken generally along line 6—6.

Also in the preferred embodiment, each catch means 32, as can best be seen by comparing FIGS. 2 and 6, includes an over-center prominence 38, over which the respective leg must pass to reach the fully extended position. In passing over that prominence 38, the leg and cross portion 12*c* or 14*c* of the respective ganging member 12 or 14 must flex, which flexure is permitted by the nature of the wire-like material from which the ganging members are formed. Once passed over the prominence 38, the ganging member 12 or 14 enters a depression 40. The prominence 38 and the flexure of the ganging member 12 or 14 combine to overcome the biasing force of the biasing means 30, to maintain the ganging member within the depression 40 until removed by intentional action. Hence by this means the ganging member 12 or 14 is held in an extended position.

Figure 7:
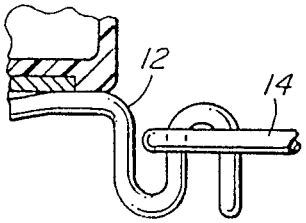
FIGS. 7 and 8 show a portion of FIG. 4, with the ganging members shown interlinked in different positions for different densities of ganging.
Figure 8:
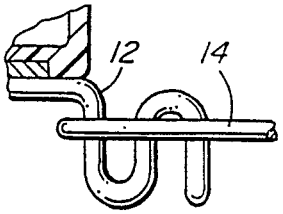

According to the invention, each of the ganging members 12 and 14 is provided with interlink means near the cross portion 12*c* and 14*c*, whereby the chair may be interlinked with an adjacent chair in ganged relation, with the legs 12*a*, 12*b*, 14*a* and 14*b* of both of the U-shaped ganging members extending between the chairs. A construction including this feature, according to a preferred embodiment of the invention, is shown at FIG. 4. As can be seen by comparing FIG. 4 to FIG. 2, leg portions 12*a* and 12*b* of ganging member 12 are each formed in an S-shape 42 at the end of the leg portions nearest the cross portion 12*c*. The S-shape is formed in a plane transverse to the cross portion. As then shown in FIG. 4, the S-shapes 42 of the ganging member 12 interlinks with the cross portion of ganging member 14 of an adjacent chair to secure the chairs in ganged relation, with the leg portion 12*a*, 12*b*, 14*a* and 14*b* of the ganging members extending between the chairs. The S-shapes 42 permit the ganging of the chairs at a plurality of different ganging densities, as can be seen by comparing FIG. 4 to FIGS. 7 and 8. The purpose of permitting different ganging densities is to allow flexibility in the addition of tablet arms and armrests. As shown in FIG. 4, the ganging member 14 of the adjacent chair is linked with the furthest portion of the S-shape 42. In FIG. 7, the ganging member 14 of the adjacent chair is shown linked with the intermediate portion of the S-shape 42, while in FIG. 8, the ganging member 14 of the adjacent chair is shown linked with the nearest portion of the S-shape 42. Thus the construction shown has the ability to provide a range of ganging densities.

Figure 9:
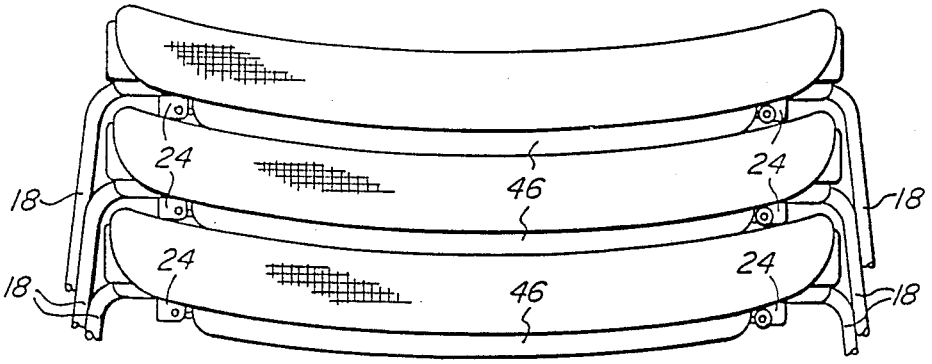
FIG. 9 is a front view of a number of chairs constructed according to a preferred embodiment of the invention, stacked one on top of another.
Figure 10:
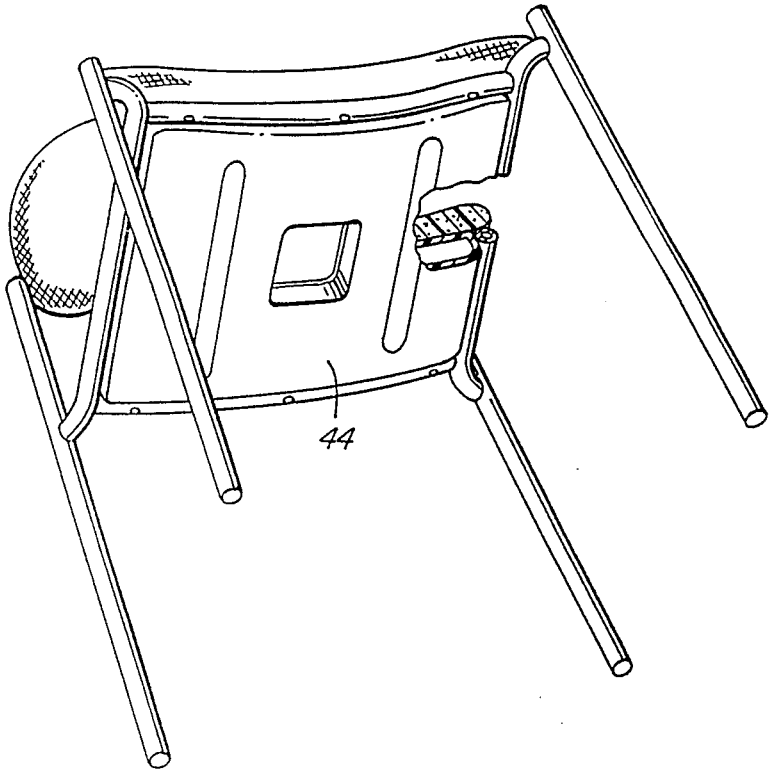
FIG. 10 PRIOR ART
FIG. 10 is an isometric view, partially cut away, of a prior art chair and stacking pad.

As shown in FIG. 9, it is an object of the invention to provide a chair which also stacks well, in addition to having retractable ganging members. As shown in FIG. 10, however, prior art chairs which were intended to be stacked were provided with a stacking pad 44 which substantially filled the entire underside of chair. As shown in FIG. 4, the S-shape 42 includes substantial vertical height. Hence a stacking pad as shown in FIG. 10 would cause the ganging member, when retracted, to protrude from the underside of the chair to an unacceptable extent, possibly causing damage to the next lower chair seat when stacked.

Accordingly, the present invention provides for a different type of stacking pad 46, as shown in FIGS. 2, 3, 4 and 9. According to the present invention, the stacking pad 46 is attached to the underside of the seat 20. The bottom surface of the stacking pad 46 conforms closely to the top surface of the seat 20, so that when another chair is placed upon the seat of a first chair, the stacking pad is supported by the entire seat. The pad thus has the effect of spreading the weight of the stack of chairs evenly over the entire seat, minimizing any stacking damage to the seat upholstery or polypropylene. The pad also assists in keeping the stack in a vertically aligned position. The pad 46 includes means for accommodating the attachment of the frame 16, to which the chair legs 18 and the hinge brackets 24 are attached. Moreover, the stacking pad 46 includes recesses 48 and 50 for accommodating the ganging members 12 and 14 respectively, and for protecting the form of these ganging members when not in use, as well as protecting the seat of the lower chair in the stack. In the most preferred embodiment, the recesses, especially recess 50 at least, are deep enough to accommodate the vertical height of the S-shape 42 of the ganging member 12. Recess 48 may be somewhat shallower, since it only needs to accommodate the ganging member 14, which is relatively straight. Each recess 48 and 50 preferably includes a finger bulge 52, to improve access to the ganging members 12 and 14 when in their retracted position.

In addition, as shown in FIG. 4, one or more bumpers 54 may be provided at the bottom of each recess 48 and 50 so as to space the ganging member 12 or 14 away from the bottom of the recess, to further improve access to and facilitate removal of the ganging members from the recesses, and also to reduce any noise which may occur when moving the ganging members to their retracted position. In the preferred embodiment, each bumper 54 is a resilient member attached to the deepest portion of the recess 48 or 50, and is attached there by inserting a portion of it through a hole formed for that purpose in the recess surface.

While the apparatus hereinbefore described is effectively adapted to fulfill the aforesaid objects, it is to be understood that the invention is not intended to be limited to the specific preferred embodiment of chair having ganging apparatus and stacking pad as set forth above. Rather, it is to be taken as including all reasonable equivalents within the scope of the following claims.

I claim:

1. Ganging apparatus for connecting chairs into rows, each of said chairs comprising a seat, having an underside, and legs for providing support to said seat, said ganging apparatus comprising:

a first ganging member connected to said seat underside near one lateral side thereof;

a second ganging member connected to said seat underside near the opposite lateral side thereof;

both of said ganging members being wire-like members formed in a generally U-shape, each with a pair of leg portions joined at one end by a cross portion, each of said ganging members being swingable between a retracted position wherein said cross portion is beneath said chair, and an extended position wherein said cross portion is extended out from under said chair;

each of said ganging members being provided with interlink means in the vicinity of the cross portion whereby said chairs may be interlinked with adjacent chairs in ganged relation, with said legs of both of said U-shapes extending between the chairs.

2. Ganging apparatus as recited in claim 1 wherein distal portions of said leg portions opposite said cross portions are bent outward and rotatably affixed to the seat underside.

3. Ganging apparatus as recited in claim 1 or claim 2 further comprising:

biasing means for biasing said ganging members toward said retracted position;

catch means for latching said ganging members in said extended position.

4. Ganging apparatus as recited in claim 3 wherein said interlink means comprises said leg portions of said first ganging member each being formed in an S-shape at the end of said leg portions nearest said cross portion, said S-shape being formed in a plane transverse to said cross portion;

whereby said S-shape of said legs of said first ganging member interlinks with said cross portion of said second ganging member of said adjacent chair to secure the chairs in ganged relation, with said legs of both of said U-shapes extending between said chairs, said S-shape thus permitting the ganging of the chairs at a plurality of different ganging densities.

5. A chair comprising:

A. a seat, having an underside;

B. ganging apparatus, including:

(1) a first ganging member connected to said seat underside near one lateral side thereof, swingable between a retracted position beneath said chair, and an extended position extended out from under said chair;

(2) a second ganging member connected to said seat underside near the opposite lateral side thereof swingable between a retracted position beneath said chair, and an extended position extended out from under said chair;

(3) both of said ganging members being wire-like members formed in a generally U-shape, each with a pair of leg portions joined at one end by a cross portion;

(4) each of said ganging members being provided with interlink means in the vicinity of said cross portion whereby said chairs may be interlinked with an adjacent chair in ganged relation, with said legs of both of said U-shapes extending between the chairs;

C. legs for providing support to said seat; and

D. a stacking pad attached to said seat underside, the bottom surface of which conforms closely to the top surface of said seat, said pad including means for accommodating the attachment of a frame, to which said legs and ganging members are attached, and including recesses for accommodating said ganging members when in said retracted position.

6. A chair as recited in claim 5 wherein distal portions of said leg portions opposite said cross portions are bent outward and rotatably affixed to the seat underside.

7. A chair as recited in claim 5 or claim 6 further comprising:

biasing means for biasing said ganging members toward said retracted position;

catch means for latching said ganging members in said extended position.

8. A chair as recited in claim 7 wherein said interlink means comprises said leg portions of said first ganging member each being formed in an S-shape at the end of said leg portions nearest said cross portion, said S-shape being formed in a plane transverse to said cross portion;

whereby said S-shape of said legs of said first ganging member interlinks with said cross portion of said second ganging member of said adjacent chair to secure the chairs in ganged relation, with said legs of both of said U-shapes extending between said chairs, said S-shape thus permitting the ganging of the chairs at a plurality of different ganging densities.

9. A chair comprising:

a seat, having a top surface and an underside;

legs for providing support to said seat; and a stacking pad attached to said seat underside, the bottom surface of which conforms closely to said top surface of said seat, said pad including means for accommodating the attachment of a frame, to which said legs are attached, and to which other hardware may be attached, and including recesses for accommodating said hardware.

10. A chair as recited in claim 9 further comprising ganging apparatus including a first ganging member connected to said seat underside near one lateral side thereof, swingable between a retracted position beneath said chair, and an extended position extended out from under said chair;

a second ganging member connected to said seat underside near the opposite lateral side thereof swingable between a retracted position beneath said chair, and an extended position extended out from under said chair;

both of said ganging members being wire-like members formed in a generally U-shape, each with a pair of leg portions joined at one end by a cross portion; and each of said ganging members being provided with interlink means at said cross portion whereby said chairs may be interlinked with an adjacent chair in ganged relation, with said legs of both of said U-shapes extending between the chairs.

11. A chair as recited in claim 10 wherein distal portions of said leg portions opposite said cross portions are bent outward and rotatably affixed to the seat underside.

12. A chair as recited in claim 10 or claim 11 further comprising:

biasing means for biasing said ganging members toward said retracted position;

catch means for latching said ganging members in said extended position.

13. A chair as recited in claim 12 wherein said interlink means comprises said leg portions of said first ganging member each being formed in an S-shape at the end of said leg portions nearest said cross portion, said S-shape being formed in a plane transverse to said cross portion;

whereby said S-shape of said legs of said first ganging member interlinks with said cross portion of said second ganging member of said adjacent chair to secure the chairs in ganged relation, with said legs of both of said U-shapes extending between said chairs, said S-shape thus permitting the ganging of the chairs at a plurality of different ganging densities.

* * * * *